US005279241A

United States Patent [19]

Aguilera

[11] Patent Number: 5,279,241

[45] Date of Patent: Jan. 18, 1994

[54] INFLATABLE SAIL

[76] Inventor: Angel R. Aguilera, P.O. Box 3298, Dana Point, Calif. 92629

[21] Appl. No.: 21,893

[22] Filed: Feb. 24, 1993

[51] Int. Cl.[5] ..... B63H 9/04

[52] U.S. Cl. ..... 114/103

[58] Field of Search ..... 114/39.1, 102, 103

[56] References Cited

U.S. PATENT DOCUMENTS

| | | | |
|---|---|---|---|
| 2,984,199 | 5/1961 | Giewald | 114/102 |
| 3,598,075 | 8/1971 | Kenney | 114/102 |
| 4,296,704 | 10/1981 | Bridge | 114/103 |
| 4,401,284 | 8/1983 | Austin | 114/103 |
| 4,463,699 | 8/1984 | Lineback | 114/39.1 |
| 4,530,301 | 7/1985 | Latham | 114/102 |
| 4,562,784 | 1/1986 | Lineback | 114/39.1 |
| 4,593,638 | 6/1986 | Cochran et al. | 114/103 |
| 4,624,203 | 11/1986 | Ferguson | 114/102 |
| 4,637,331 | 1/1987 | Jackson | 114/103 |
| 4,649,848 | 3/1987 | Belvedere | 114/103 |
| 4,699,073 | 10/1987 | Farneti | 114/102 |
| 4,708,078 | 11/1987 | Legaignoux et al. | 114/102 |
| 4,708,079 | 11/1987 | Magnan | 114/103 |
| 4,733,624 | 3/1988 | Belvedere | 114/103 |
| 4,753,186 | 6/1988 | Paras | 114/103 |
| 4,757,779 | 7/1988 | Graveline | 114/103 |
| 4,766,831 | 8/1988 | Johnston | 114/102 |
| 4,879,961 | 11/1989 | Aguilera | 114/102 |
| 5,095,837 | 3/1992 | Baird | 114/103 |

FOREIGN PATENT DOCUMENTS

| | | | |
|---|---|---|---|
| 2658772 | 12/1976 | Fed. Rep. of Germany | 114/102 |
| 3211641 | 3/1982 | Fed. Rep. of Germany | 114/103 |
| 603392 | 12/1977 | Switzerland | 114/102 |
| 1121180 | 10/1984 | U.S.S.R. | 114/103 |
| 11553056 | 5/1969 | United Kingdom . | |

*Primary Examiner*—Jesus D. Sotelo

*Attorney, Agent, or Firm*—Gordon L. Peterson

[57] ABSTRACT

An inflatable sail comprising an inflatable enclosure having opposed flexible walls. The enclosure has a sail shape when the enclosure is inflated with an inflation medium. The walls are movable toward each other when the enclosure is deflated. A porous conduit is within the enclosure between the walls and is communicable with the exterior of the enclosure so that inflation medium can be removed from the enclosure through the conduit. The opposed walls are joined together at a plurality of regions to form a plurality of spaced batten pockets which extend from the leech of the sail across the roach.

19 Claims, 4 Drawing Sheets 43
47
55
59
45

17
19
41
11
75
57
25
55
47
27
83
51
13
57
33
55
47
5
61
5
88
63
71
89'
84
47
55
5A
86
99
98
97
55
3
5A
75'
85
83'
4
96
3
71'
53
21
57
35
4
61
79
79'
23
29
15
31
37
39
40
28

INFLATABLE SAIL

BACKGROUND OF THE INVENTION

My patent U.S. Pat. No. 4,879,961 discloses an inflatable sail which provides many advantages. Generally, an inflatable sail includes an inflatable enclosure having opposed flexible walls. The enclosure has a sail shape when the enclosure is inflated with an inflation medium. The walls are movable toward each other when the enclosure is deflated. An inflatable sail is believed to provide more power than conventional fabric sails.

An air pump is used to inflate and deflate the inflatable sail. During deflation, the walls of the sail tend to come together and seal off the opening through which the inflation medium is being evacuated thereby trapping air in the sail. Kinks or folds in the sail can also inhibit evacuation of inflation medium from the sail.

To increase the area of a noninflatable sail, it is known to provide the sail with a roach. To stabilize the roach, it is desirable to utilize battens which extend from the leech of the sail across the roach. It would also be desirable to increase the area of an inflatable sail.

SUMMARY OF THE INVENTION

This invention provides an inflatable sail with a feature that substantially prevents trapping of air and facilitates rapid deflation of the sail even though the walls of the sail collapse toward each other and even if there are folds or kinks in the sail. In addition, this invention provides novel batten pockets which extend across the roach and which do not allow for any significant escape of inflation medium from the inflatable sail. These features can be used together or independently.

According to one feature of this invention, a porous conduit is provided within the inflatable enclosure between the walls of the enclosure. The conduit is communicable with the exterior of the enclosure so that inflation medium can be removed from the enclosure through the conduit.

The conduit may be made porous in various different ways. For example, the entire conduit or portions thereof may be permeable to the inflation medium, which is typically air. Alternatively, the conduit may include a plurality of openings along its length. In any event, the conduit allows the inflation medium to enter through the pores or openings and travel through the conduit to the exterior of the inflatable sail during the deflation process.

To obtain greater benefit from the conduit, it preferably extends over a major portion of a major dimension of the inflatable enclosure. To retain the conduit in this position, an appropriate attachment device is utilized. Preferably, this attachment device couples the conduit to at least one of the walls so that the conduit is retained in a position in which the conduit extends over the major portion of the major dimension.

The conduit is preferably flexible. The inflatable sail also preferably includes a valve coupled to the conduit for selectively blocking the removal of inflation medium from the enclosure through the conduit.

These features of the invention are applicable to various different kinds of sails including a mainsail, jib, roller furling sail and spinnaker. For example, when the sail is in the shape of a mainsail or jib sail, the conduit preferably extends along the luff for a major length of the luff. It is preferred to locate the conduit in the luff region of these sails because this region undergoes the least movement when tacking. On the other hand, for a roller furling sail, the conduit preferably extends along the leech for a major length of the leech. This enables the conduit to be used in removing inflation medium to allow reefing of the sail. Finally, for a spinnaker sail, it is preferred to utilize two of the conduits, one extending along each of the luffs of the sail. This position is preferred because at the center of the spinnaker there is typically no inflation.

These features of the invention are also applicable to sails which can be reefed. This can be accomplished, for example, with the inflatable enclosure including first and second inflatable compartments and with first and second porous conduits which extend into the first and second compartments, respectively. By placing the first compartment above the second compartment, the second or lower compartment can be deflated to allow the sail to be reefed. In a preferred construction, the first porous conduit extends through the second or lower compartment into the first or upper compartment and the inflatable sail includes a spring within the portion of the first porous conduit that is in the second compartment. The spring prevents the portion of the first porous conduit that is in the second compartment from collapsing when the sail is reefed. In a preferred construction, a baffle is provided within the inflatable enclosure for sealing the first compartment from the second compartment. Multiple compartments and multiple porous conduits can be used for purposes other than reefing, and may be located in side-by-side or other orientations.

In order to extend the area of the inflatable sail, another feature of this invention provides for novel batten pockets which extend from the leech across the roach. This accomplished by joining together a plurality of regions of the opposed walls to form a plurality of spaced batten pockets. The opposed walls are preferably sealed together at such regions to substantially prevent inflation medium from escaping from the enclosure by passing into the batten pockets. The batten pockets are preferably open adjacent the leech and are closeable.

The invention, together with additional features and advantages thereof may best be understood by reference to the following description taken in connection with the accompanying illustrative drawings.

DESCRIPTION OF THE PREFERRED EMBODIMENT

Figures 1, 3:
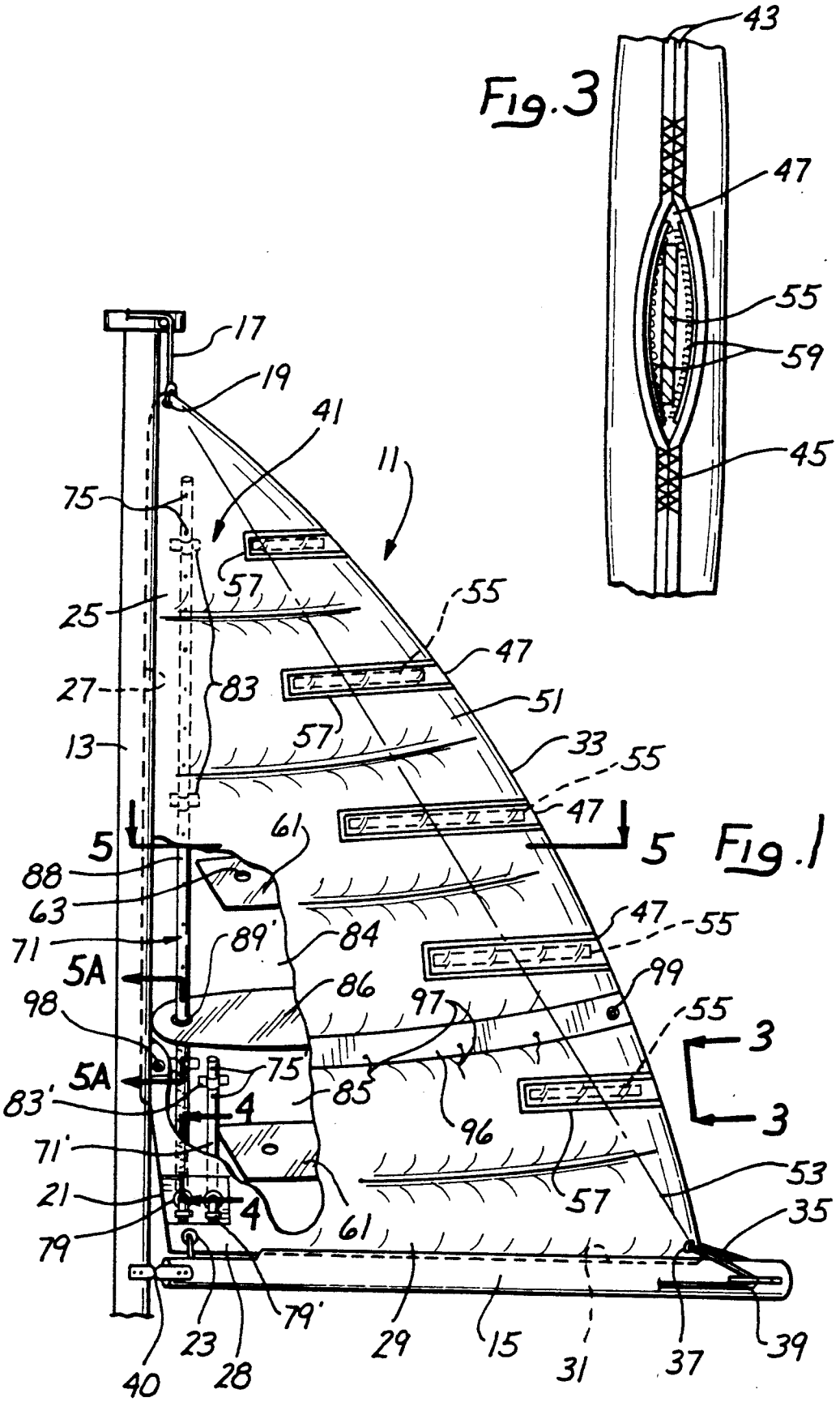
FIG. 1 is a side elevational view with portions broken away of an inflatable sail, a mast and a boom with the inflation-deflation valve removed and with portions of the gussets and baffle being shown in perspective.
FIG. 3 is an enlarged fragmentary end elevational view taken generally along line 3—3 of FIG. 1.

FIG. 1 shows an inflatable mainsail 11 coupled to a mast 13 and a boom 15 in a conventional manner utilizing conventional rigging and hardware. Thus, a halyard 17 is coupled to a head grommet 19 and a bolt rope 21 is attached as by sewing to a luff 25 of the inflatable sail 11. The luff 25 is received in a groove 27 of the mast 13 and a bolt rope 28 is attached to a foot 29 which is received in a sail groove 31 of the boom 15. For masts having double grooves, double luffs may be provided on the sail. A tack grommet 23 is used to attach a lower forward region of the sail 11 to the boom 15. The sail 11 also has a leech 33 and an outhaul 35 extends through a clew grommet 37 and over a pulley 39 on the boom 15 in a conventional manner. The boom 15 is coupled to the mast 13 in the usual manner by a goose neck 40 for pivotal movement of the boom relative to the mast.

Figure 2:
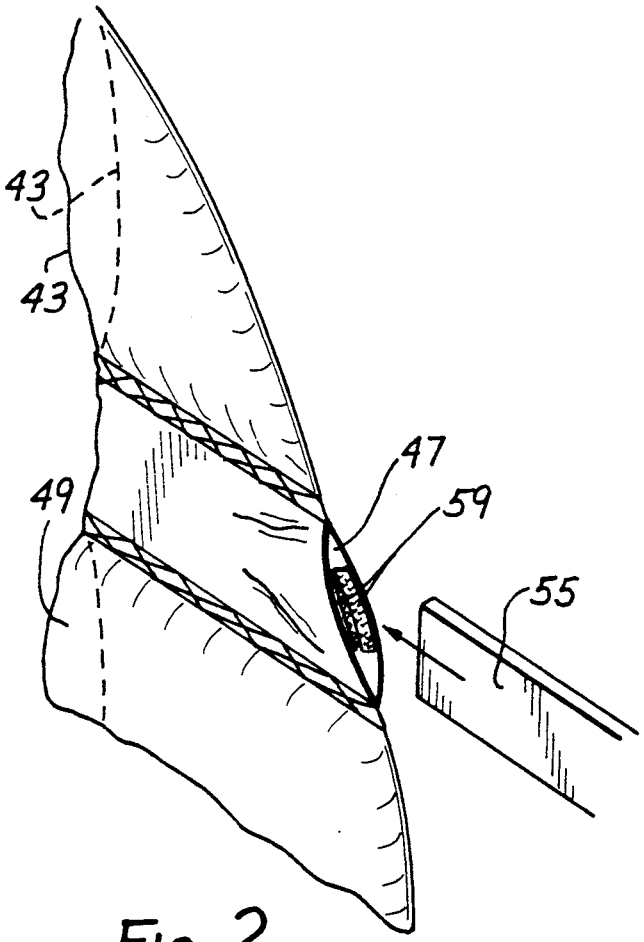
FIG. 2 is an enlarged fragmentary perspective view illustrating a portion of the sail and one of the battens about to be inserted into a batten pocket.

The inflatable sail 11 includes an inflatable enclosure 41 having opposed flexible walls 43 (FIGS. 2 and 3) and a sail shape when the enclosure 41 is inflated with an inflation medium, such as air. In this embodiment, the enclosure has a generally triangular configuration as viewed in side elevation and is in the shape of a mainsail. However, the features of this invention discussed in connection with the mainsail 11 of FIG. 1 apply equally to a jib sail.

Generally, the sail shape of the enclosure 41 may be any configuration usable to generate a force from the wind to propel a vehicle, such as a sail boat or sail board, and as such may be generally in the form of a mainsail, jib, roller furling sail or spinnaker. In terms of the cross section of the sail, a "sail shape" has reference to a configuration useful for converting the force of the wind into a driving force for the vehicle to which it is attached. As such, the sail preferably has an aerodynamic cross section and preferably has an airfoil configuration.

Although various constructions are possible, the walls 43 are joined together along the full length of the periphery 45 thereof except at batten pockets 47 as described herein below. The walls 43 may be joined together in any suitable manner that will provide the periphery 45 with a joint or seam that is substantially impervious to the inflation medium. For example, the periphery 45 may be joined together by stitching, tape, adhesive or any combination of these that will provide a joint which is impervious to the inflation medium at the pressures being utilized. Stitching alone ordinarily will not suffice.

The walls 43 may be made of any material which is substantially impervious to the inflation medium at the pressures being utilized. For example, the walls 43 may be constructed of conventional sail fabric with a suitable polymeric coating such as polyester, polyurethane, Mylar or the like. When constructed in this fashion, the enclosure 41 has an interior chamber 49 (FIG. 2) adapted to receive the inflation medium to inflate the inflatable enclosure 41.

The inflatable sail 11 has an enlarged area or roach 51. The roach 51 is that portion of the sail aft of an imaginary straight line 53 extending between the head grommet 19 and the clew grommet 37. In order to properly utilize this extra area or roach 51, the batten pockets 47 and associated battens 55 are provided. The batten pockets 47 are provided by joining together regions 57 of the walls 43. As shown in FIG. 1, the batten pockets 47 are parallel and spaced from each other, and they extend from the leech 33 entirely across the roach 51 and into that portion of the sail forward of the imaginary line 53. The walls 43 are sealed together along the region 57 so as to substantially prevent inflation medium from escaping from the chamber 49 of the enclosure 41 by passing into the batten pockets 47. The sealing of the walls 43 along the region 57 may be accomplished with stitching, tape, adhesive or any combination of these. Stitching alone is unlikely to suffice.

The batten pockets 47 are elongated and rectangular as viewed in side elevation and sized to receive the battens 55, respectively. The batten pockets 47 are of different lengths and each of them extends across and beyond the roach 51.

The batten pockets 47 are open adjacent the leech 33 and are closeable. Although the batten pockets 47 may be closed in various different ways, in this embodiment, this is accomplished using a suitable quick release fastener such as hook and eye material 59 (FIG. 3) affixed to the interior of the walls 43. A common form of hook and eye material is available under the trademark Velcro.

Figure 5:
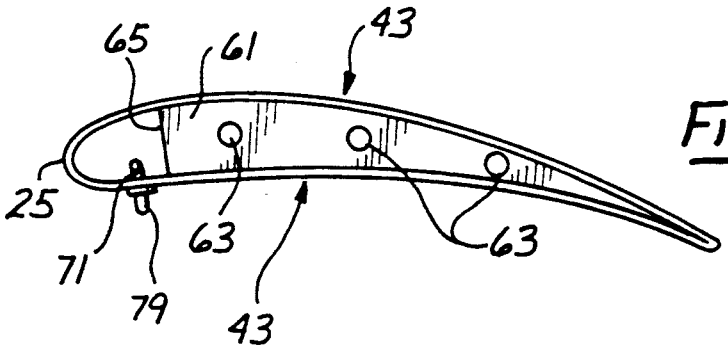
FIG. 5 is a sectional view taken generally along line 5—5 of FIG. 1.

When inflated, the enclosure 41 has an airfoil configuration as best seen in FIG. 5. To assist in shaping the enclosure into an airfoil configuration, the walls 43 are of an appropriate size and configuration and a plurality of gussets 61 are fixed to the opposite walls 43 in any suitable manner such as by an adhesive or tape. Each of the gussets is of airfoil configuration and has apertures 63 for the passage of inflation medium. Each of the gussets 61 is generally in the form of an airfoil of a flexible sail material and terminates in a forward edge 65 spaced slightly aft of the luff 25. The gussets 61 are spaced vertically as desired to provide the airfoil configuration. The gussets 61 serve to hold or restrain the walls 43 in an airfoil shape when the enclosure 41 is inflated.

Figure 4:
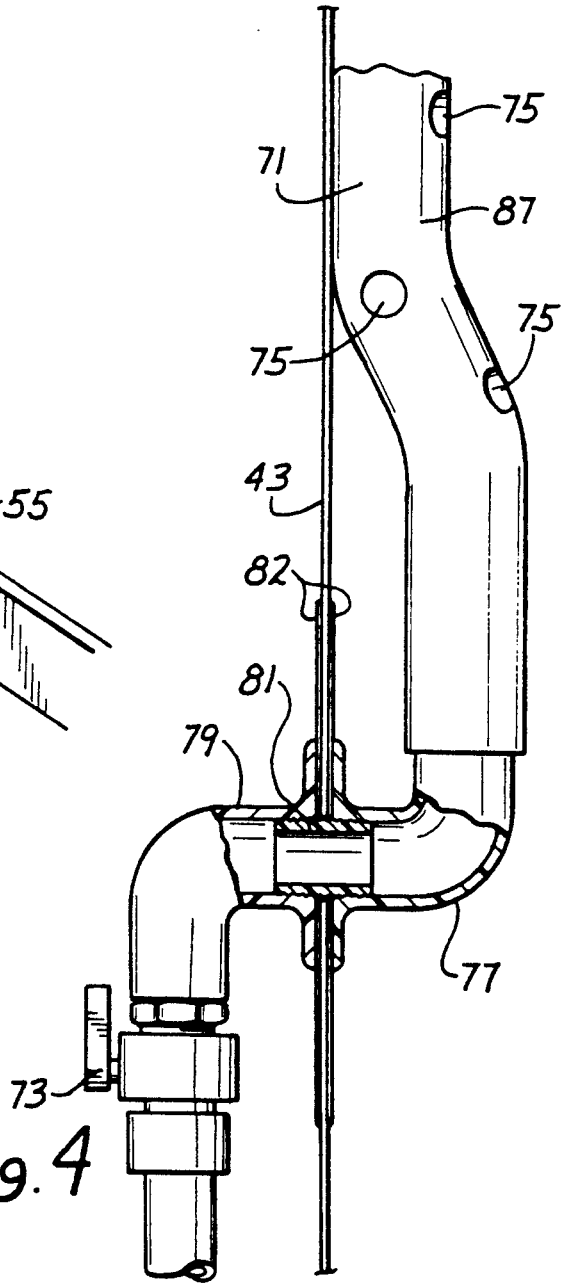
FIG. 4 is an enlarged view partially in section taken generally along line 4—4 of FIG. 1.

A porous conduit 71 is provided in the chamber 49 of the enclosure 41 between the walls 43. The conduit 71 extends upwardly in the enclosure 41 forwardly of the forward edge 65 of each of the gussets 61 as shown in FIG. 5. The conduit 71 is communicable with the exterior of the enclosure 41 via an inflation-deflation valve 73 (FIG. 4) which is coupled to the conduit for selectively blocking the removal of inflation medium from the chamber 49 to the conduit. In this embodiment, the valve 73 is a manual shutoff valve which can be opened to allow inflation and deflation of the sail. The conduit 71 is preferably a flexible polymeric tube which has many openings 75 along its length. As shown in FIG. 4, the openings 75 are preferably offset circumferentially and axially so that it is less likely that all of the openings 75 would be blocked by the collapsing of the walls 43 during deflation.

An attachment device is provided for coupling the conduit 71 to one of the walls 43. In this embodiment, there are a plurality of individual elements that are used to accomplish this function. With reference to FIG. 4, the lower end of the conduit 71 is coupled to an interior fitting 77 which is in turn coupled to an exterior fitting 79 by an externally threaded sleeve 81 (FIG. 4). With this arrangement, the fittings 77 and 79 clamp a region of the wall 43 and layers 82 of a reinforcing fabric between them and both of the fittings are securely mounted on the wall and may also be adhesively bonded to the layers 82. Of course, the fittings 77 and 79 may be considered as part of the conduit 71 if desired.

In addition, the attachment device also includes a plurality of spaced apart segments of tape 83 (FIG. 1) for taping the conduit 71 to the wall 43 to which the interior fitting 77 is mounted. Of course, mechanical fasteners, adhesive and the like may be used in lieu of, or in addition to, the tape 83 to accomplish the attaching function.

It is desirable that the conduit 71 have sufficient length to enable it to be useful in removing the inflation medium from the enclosure even if the enclosure is kinked or folded. To achieve this, the conduit 71 preferably extends over a major portion of a major dimension of the enclosure 41. In addition, the conduit 71 is located so it will have negligible or minimal effect on the operation of the sail.

With reference to FIG. 1, which illustrates a mainsail, it can be seen that the conduit 71 extends generally along the luff 25 for almost the full length of the luff. By locating the conduit 71 along the luff 25, the conduit undergoes the least movement when tacking. More specifically, in this embodiment the conduit 71 extends from a lower location close to or adjacent the boom 15 to an upper location near the head grommet 19. When applied to a jib sail, which may have the same general shape as the mainsail of FIG. 1, the conduit 71 may also extend along the luff substantially as shown in FIG. 1. The segments of tape 83 retain the conduit 71 in a position in which it extends over the desired major portion of the major dimension of the sail 11.

An optional feature of the invention which adapts the inflatable sail 11 to be reefed includes providing the inflatable enclosure 41 with an upper inflatable compartment 84 and a lower inflatable compartment 85. The upper compartment 84 is above the lower compartment 85, and a baffle 86 (FIG. 1) may be used to divide the enclosure 41 into the compartments 84 and 85. The baffle 86 seals the compartments 84 and 85 from each other. For this purpose, the baffle 86 may be constructed of any suitable flexible, air impervious material such as sail cloth covered with a suitable air impervious polymeric film. The baffle 86 is attached to the walls 43 in any suitable airtight manner, such as by an adhesive and/or tape 86' (FIG. 5A) and the gussets 61 may be attached to the walls 43 in the same manner. The baffle 86, like the gusset 61, has an airfoil configuration.

A second porous conduit 71' extends into the lower compartment 85 and terminates in the compartment 85 below the baffle 86. The conduit 71' may be similar to a length of the conduit 71, and it includes a plurality of longitudinally and circumferentially spaced openings 75'. The conduit 71' may be mounted within the enclosure 41 in the same manner as the conduit 71, i.e. by tape 83' and by an external fitting 79'. A separate manual valve (not shown) which may be identical to the valve 73 may be used to allow inflation and deflation of the compartment 85. Similarly, when the enclosure 41 comprises the two compartments 84 and 85, the manual valve 73 is openable to allow inflation and deflation of only the compartment 84.

Figure 5A:
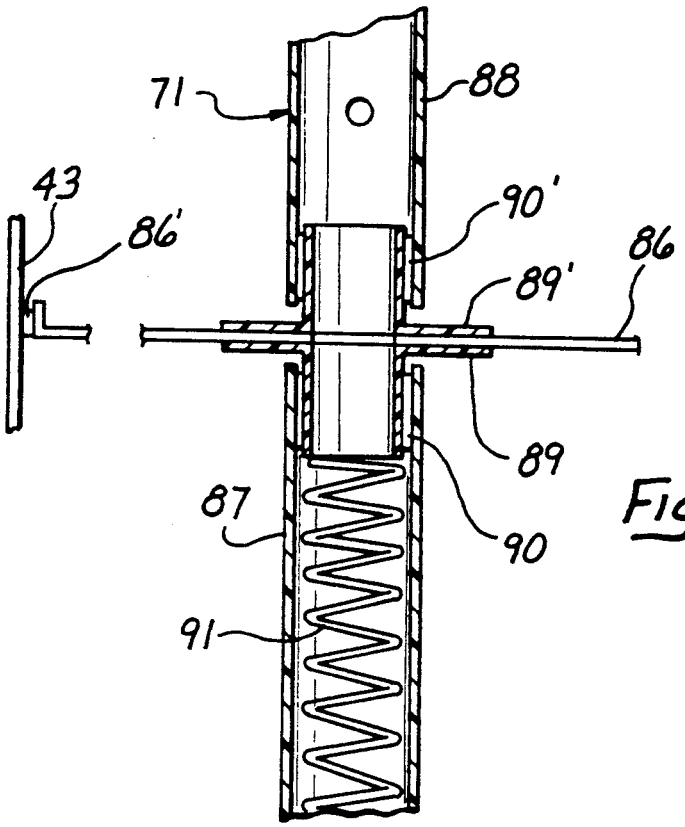
FIG. 5A is an enlarged fragmentary sectional view taken generally along line 5A—5A.

FIGS. 1 and 5A show a preferred construction for the conduit 71 adjacent the baffle 86. Of course, for those inflatable sail constructions which do not employ the baffle 86, the conduit 71 need not include the construction of FIG. 5A.

As shown in FIG. 5A, the porous conduit 71 includes an imperforate or nonporous lower conduit section 87 in the lower compartment 85 and a perforate or porous upper conduit section 88 in the upper compartment 84. The nonporous conduit section 87 allows the upper compartment 84 to be inflated and deflated. The lower conduit section 87 is coupled at its lower end to the interior fitting 77 (FIG. 4) and at its upper end to a fitting 89 which is bonded to the baffle 86. The upper end of the lower conduit section 87 is bonded by a suitable bonding material 90 to the fitting 89.

Similarly, the lower end of the upper conduit section 88 is bonded with bonding material 90' to a fitting 89' which is in turn suitably bonded to the baffle 86. The baffle 86 and the fittings 89 and 89' have an opening to provide communication between the interiors of the conduit sections 87 and 88. A spring 91 is provided within the lower conduit section 87 to prevent collapse of the passage through the conduit section 87 when the sail 11 is reefed.

A reefing strip 96 of flexible sail cloth material is attached, as by an adhesive, to one of the walls 43 and reefing ties 97 are suitably coupled to the reefing strip. A similar reefing strip 96 with reefing ties 97 is provided on the side of the sail 11 which is not shown in FIG. 1. The sail 11 also has reefing grommets 98 and 99.

In use, the inflatable sail 11 can be inflated through the conduits 71 and 71' and the openings 75 and 75' by opening of the valve 73 and the corresponding valve (not shown) for the conduit 71' and coupling them to a source of inflation medium under pressure, such as air. Conversely, the inflatable sail 11 can be deflated through the openings 75 and 75' and the conduits 71 and 71' by opening of these valves. To reef the sail 11, the compartment 85 is deflated utilizing the conduit 71' and the sail is lowered. The resulting loose sail material, which forms the compartment 85, is rolled into a roll and tied with the reefing ties 97. The reefing grommets 98 and 99 are used in the usual manner to secure the reefed sail to the boom 15.

Figures 6, 6A, 6B:
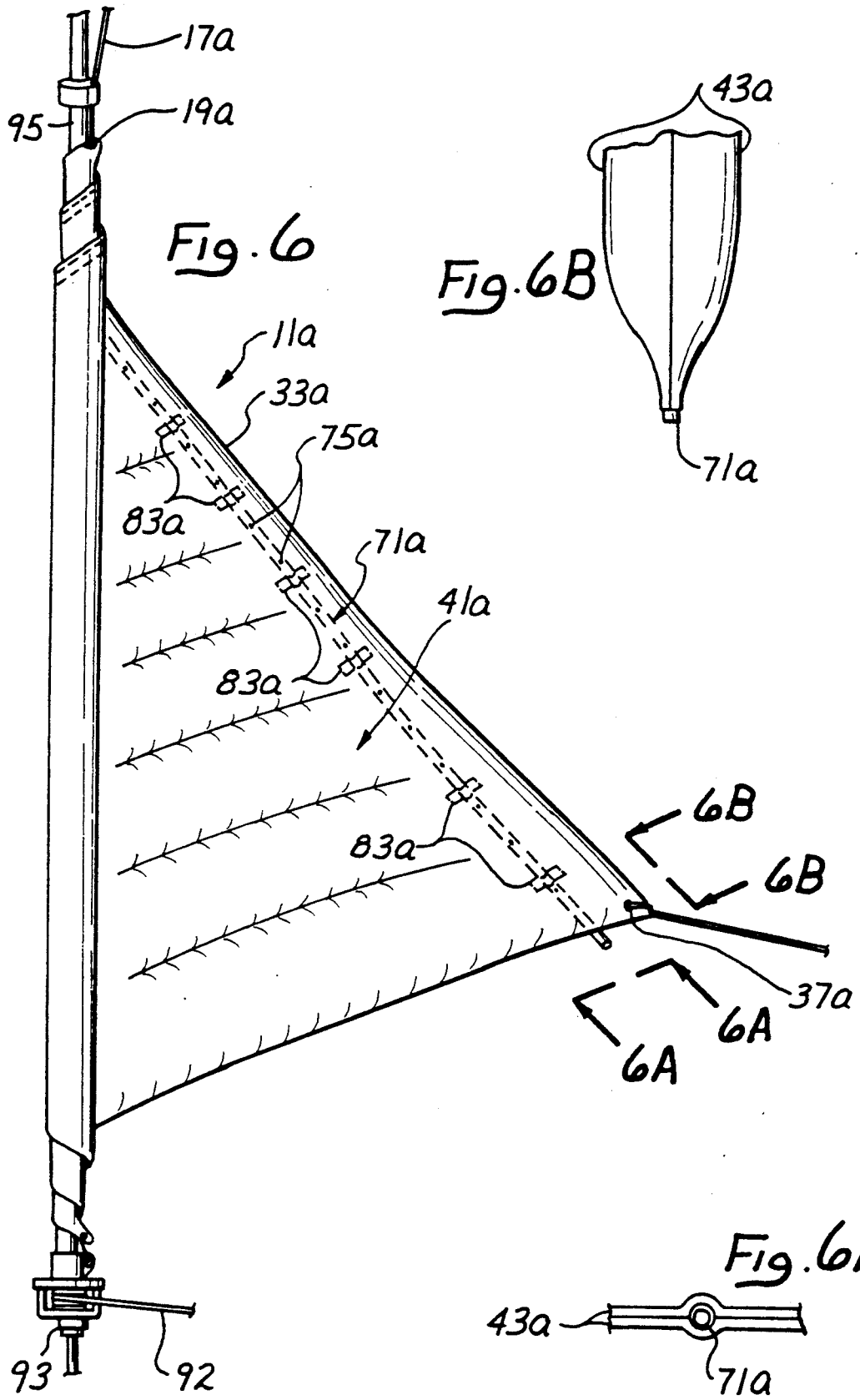
FIG. 6 is an elevational view similar to FIG. 1 illustrating a roller furling sail.
FIGS. 6*a* and 6*b* are enlarged fragmentary views taken generally along line 6*a*—6*a* and 6*b*—6*b*, respectively.

FIG. 6 shows an inflatable sail 11*a* in the form of a roller furling sail. The sail 11*a* is identical to the sail 11 in all respects not shown or described herein. Except for the inflatable nature of the sail 11*a* and the conduit 71*a*, the roller furling sail of FIG. 6 may be conventional. Portions of the sail 11*a* corresponding to portions of the sail 11 are designated by corresponding reference numerals followed by the letter *a*.

The sail 11*a* has a conventional furling line 92 and furling system 93 such that a shaft 95 of the furling system can be rotated about its longitudinal axis to reef the sail in a known manner. The sail 11*a* does not employ battens and the gussets employed in the sail 11*a* (which may be accordance with FIG. 6) are sufficiently flexible to allow them to collapse and roll up about the shaft 95.

The conduit 71*a* with its openings 75*a* may be identical to the conduit 71 except that the conduit 71*a* has only a single conduit section and it extends generally along the leech 33*a* for a major length of the leech. Specifically, the conduit 71*a* may extend from a location closely adjacent the head grommet 19*a* along the leech 33*a* and out the bottom of the sail near the clew grommet 37*a* as shown in FIG. 6. Tape segments 83*a* may be employed as with the sail 11 to retain the conduit 71*a* in the desired position. The sail 11*a* is inflatable as shown in FIG. 6*b* and may be made inflatable in the same manner as the sail 11.

Another difference between the sails 11*a* and 11 is that the conduit 71*a* exits through the bottom of the sail between the walls 43*a* and is appropriately sealed as by an adhesive and tape to the walls 43*a* at the location where the conduit exits from the enclosure 41*a*. The conduit may be connected to a valve (not shown) just outside of the enclosure 41*a*. By locating the conduit 71*a* along the leech 33*a*, the conduit can be used in removing inflation medium to enable reefing the sail. The sail 11*a* has only a single compartment and does not include a porous conduit corresponding to the conduit 71' of FIG. 1 or a baffle corresponding to the baffle 86 of FIG. 1.

The sail 11*a* can be inflated and deflated as described above for the sail 11. In addition, the rolling furling sail of FIG. 6 can be partially deflated to allow the sail to be reefed.

Figure 7:
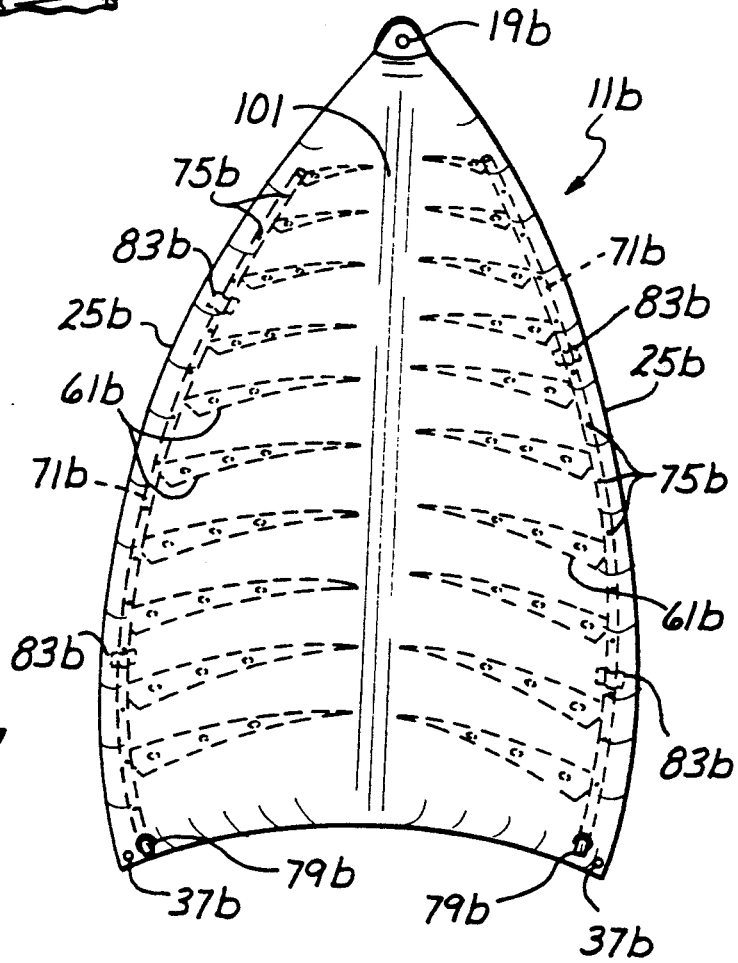
FIG. 7 is a perspective view of a spinnaker sail constructed in accordance with the teachings of this invention.

FIG. 7 shows an inflatable sail 11*b* in the form of an inflatable spinnaker sail. The sail 11*b* is identical to the sail 11 in all respects not shown or described herein. Portions of the sail 11*b* corresponding to portions of the sail 11 are designated by corresponding reference numerals followed by the letter *b*.

The primary differences between the sails 11 and 11*b* is that the latter has a sail shape in the form of a spinnaker sail and has two of the conduits 71*b* with openings 75*b* extending along the luffs 25*b* of the sail. The sail 11*b* can be constructed by employing spinnaker shaped sail material and two sets of gussets 61*b* bonded to the interior of the enclosure 41*b* as described in connection with the sail 11. A central region 101 extending vertically through the sail 11*b* is noninflatable, i.e. the opposite walls of the sail are sealed together in this region. Thus, there are two inflatable chambers or compartments on the opposite sides of the central region 101.

The conduits 71*b* extend generally along the luffs 25*b*, respectively, for a major length of the associated luff, and thus may be positioned with respect to the airfoil configuration substantially as shown in FIG. 5. Tape segments 83*b* hold each of the conduits 71*b* in the position shown in FIG. 7, and each of the conduits 71*b* may be coupled to a wall of the sail 11*b* in the manner shown in FIG. 4 and be coupled to a manual valve (not shown). The spinnaker 11*b* can be inflated and deflated in the same manner as the sail 11 except that two of the valves 73*b* must be operated to inflate and deflate both sides of the sail 11*b*. which can be opened to allow inflation and deflation of the sail 11*b*.

Although exemplary embodiments of the invention have been shown and described, many changes, modifications and substitutions may be made by one having ordinary skill in the art without necessarily departing from the spirit and scope of this invention.

I claim:

1. An inflatable sail comprising:

an inflatable enclosure having opposed flexible walls and at least a first inflatable compartment, said enclosure having a sail shape when the enclosure is inflated with an inflation medium, said walls being movable toward each other when the enclosure is deflated; and a porous conduit within the enclosure between said walls and communicable with the exterior of the enclosure, the porous conduit having a plurality of openings along the length of the conduit in said first inflatable compartment whereby inflation medium can be removed from the enclosure through the conduit.

2. An inflatable sail as defined in claim 1 wherein the porous conduit extends over a major portion of a major dimension of the enclosure.

3. An inflatable sail as defined in claim 2 including an attachment device for coupling the conduit to at least one of said walls so that the conduit is retained in a position in which the conduit extends over said major portion of said major dimension.

4. An inflatable sail as defined in claim 2 wherein the conduit includes a flexible tube having a plurality of openings along the length of the tube and a valve coupled to the conduit for selectively blocking the removal of inflation medium from the enclosure through the conduit.

5. An inflatable sail as defined in claim 1 wherein the enclosure has at least one luff and when inflated is in the shape of a mainsail or jib sail and the conduit extends generally along the luff for a major length of the luff.

6. An inflatable sail as defined in claim 1 wherein the enclosure has a leech and is adapted for use as a roller furling sail and the conduit extends generally along the leech for a major length of the leech.

7. An inflatable sail as defined in claim 1 wherein the enclosure when inflated is in the shape of a spinnaker having first and second luffs, said conduit is a first porous conduit, the inflatable sail includes a second porous conduit, and said first and second conduits extend generally along the first and second luffs, respectively, for a major length of the associated luff.

8. An inflatable sail as defined in claim 1 wherein enclosure has a roach and a leech and the opposing walls are joined together at a plurality of regions to form a plurality of spaced batten pockets which extend from the leech across the roach.

9. An inflatable sail as defined in claim 8 wherein opposed walls are sealed together at said plurality of regions to substantially prevent inflation medium from escaping from the enclosure by passing into the batten pockets.

10. An inflatable sail as defined in claim 1 wherein said inflatable enclosure includes a second inflatable compartment, said porous conduit is a first porous conduit and the inflatable sail includes a second porous conduit, said first and second porous conduits extend into the first and second compartments, respectively and the first porous conduit extends through the second compartment into the first compartment.

11. An inflatable sail as defined in claim 10 wherein said first compartment is above the second compartment when the inflatable sail is in use.

12. An inflatable sail as defined in claim 11 wherein the inflatable sail includes a spring within a portion of the first porous conduit that is in the second compartment.

13. An inflatable sail as defined in claim 11 including a flexible baffle within the inflatable enclosure for sealing the first compartment from the second compartment.

14. An inflatable sail comprising:

an inflatable enclosure having opposed flexible walls, said inflatable enclosure having a sail shape when inflated with an inflation medium and a roach and a leech; and said opposed walls being joined together at a plurality of regions to form a plurality of spaced batten pockets which extend from the leech across the roach.

15. An inflatable sail as defined in claim 14 wherein the opposed walls are sealed together at said plurality of regions to substantially prevent inflation medium from escaping from the enclosure by passing into the batten pockets.

16. An inflatable sail as defined in claim 14 wherein the batten pockets open adjacent the leech and are closable.

17. An inflatable sail as defined in claim 14 including a batten in each of said pockets.

18. An inflatable sail as defined in claim 14 wherein said batten pockets are generally parallel and some of the batten pockets are larger than other of the batten pockets.

19. An inflatable sail comprising:

an inflatable enclosure having opposed flexible walls and at least one inflatable compartment, said enclosure having an airfoil shape when the enclosure is inflated with an inflation medium, said walls being movable toward each other when the enclosure is deflated;

a flexible conduit having a plurality of openings along the length of the conduit in said one inflatable compartment, said conduit being within the enclosure between said walls and communicable with the exterior of the enclosure whereby inflation medium can be removed from the enclosure through the conduit to substantially prevent trapping of air within said one inflatable compartment, the conduit extending over a major portion of a major dimension of the enclosure;

an attachment device for coupling the conduit to at least one of said walls so that the conduit is retained in a position in which the conduit extends over said major portion of said major dimension; and a valve coupled to the conduit for selectively blocking the removal of inflation medium from the enclosure through the conduit.

* * * * *